US009537209B2

(12) United States Patent
Petkov et al.

(10) Patent No.: US 9,537,209 B2
(45) Date of Patent: Jan. 3, 2017

(54) ANTENNA ARRAY WITH REDUCED MUTUAL COUPLING BETWEEN ARRAY ELEMENTS

(71) Applicant: Space Systems/Loral, LLC, Palo Alto, CA (US)

(72) Inventors: Peter Z. Petkov, Mountain View, CA (US); Peter S. Simon, Camarillo, CA (US)

(73) Assignee: Space Systems/Loral, LLC, Palo Alto, CA (US)

( * ) Notice: Subject to any disclaimer, the term of this patent is extended or adjusted under 35 U.S.C. 154(b) by 580 days.

(21) Appl. No.: 13/896,181

(22) Filed: May 16, 2013

(65) Prior Publication Data

US 2014/0340271 A1 Nov. 20, 2014

(51) Int. Cl.

| | |
|---|---|
| ***H01Q 1/52*** | (2006.01) |
| ***H01Q 21/06*** | (2006.01) |
| ***H01Q 13/02*** | (2006.01) |

(52) U.S. Cl.

CPC ..... *H01Q 1/523* (2013.01); *H01Q 13/0266* (2013.01); *H01Q 21/064* (2013.01)

(58) Field of Classification Search

CPC ... H01Q 1/523; H01Q 13/0266; H01Q 21/064
USPC ..... 343/776, 786
See application file for complete search history.

(56) References Cited

U.S. PATENT DOCUMENTS

| | | | | |
|---|---|---|---|---|
| 2,947,987 | A | 8/1960 | Dodington | |
| 2,989,747 | A | 6/1961 | Atchison | |
| 2,998,602 | A | 8/1961 | Cacheris | |
| 3,277,488 | A | 10/1966 | Hoffman | |
| 4,115,782 | A | 9/1978 | Han et al. | |
| 4,219,820 | A | 8/1980 | Crail | |
| 4,712,110 | A | 12/1987 | Branigan et al. | |
| 4,819,004 | A * | 4/1989 | Argintaru | H01Q 21/064 343/778 |
| 5,047,787 | A | 9/1991 | Hogberg | |
| 6,483,475 | B1 | 11/2002 | Tokudat | |
| 6,515,633 | B2 | 2/2003 | Ippolito | |
| 7,427,967 | B2 | 9/2008 | Hughes | |
| 7,616,168 | B2 | 11/2009 | Tillery | |
| 8,253,645 | B2 | 8/2012 | Derneryd | |
| 2009/0184881 | A1 * | 7/2009 | Bullock | H01Q 1/288 343/873 |

* cited by examiner

*Primary Examiner* — Robert Karacsony
(74) *Attorney, Agent, or Firm* — Weaver Austin Villeneuve & Sampson LLP

(57) ABSTRACT

An array of antenna feed elements includes a plurality of horns, each horn having an aperture and configured for transmission of electromagnetic energy therethrough. At least a first horn is configured with an electrically conductive external surface proximate to the aperture, the external surface contoured so as to reduce mutual coupling between the first horn and an adjacent horn. Where the electromagnetic energy is within a radio frequency (RF) band, the external surface is contoured so as to provide an abrupt change in a gap dimension between the first horn and an adjacent horn, the change occurring at a distance behind the aperture of equal to a multiple of one half the characteristic wavelength of the RF band.

18 Claims, 8 Drawing Sheets

Plot B (PRIOR ART)

Plot A

Plot C

Plot D (PRIOR ART)

ANTENNA ARRAY WITH REDUCED MUTUAL COUPLING BETWEEN ARRAY ELEMENTS

TECHNICAL FIELD

This disclosure relates to a microwave antenna array including multiple horn-like antenna array elements and, more particularly, to an array having at least one horn with a contoured external surface configured to reduce mutual coupling with an adjacent horn.

BACKGROUND OF THE INVENTION

The assignee of the present invention manufactures and deploys spacecraft for, inter alia, communications and broadcast services. Antenna systems for such spacecraft may include array-fed reflectors, for generating shaped beams corresponding to specific antenna pattern coverage requirements.

A feed array configured for the transmission of RF energy therethrough may be communicatively coupled with an antenna reflector and may include an array of multiple feed elements configured as horns. Center-to-center spacing $d_{c\text{-}c}$ between adjacent horns in such a feed array is, desirably, made as small as possible in order to provide a maximal degree of pattern control for the shaped beam. For horns having a circular aperture, based on cutoff of the dominant circular waveguide mode, $d_{c\text{-}c}$ should be no less than approximately 1.2λ, where λ is the wavelength corresponding to the lowest frequency of the RF energy (the "characteristic wavelength"). Moreover, $d_{c\text{-}c}$ must exceed the horn aperture outer diameter, $d_a$, so as to ensure a positive "gap" between horns at the aperture plane. This gap may be for example, about $1/20^{th}$ of the aperture diameter.

Aperture efficiency, which may be characterized by a metric referred to as peak directivity, is a critical performance metric for feed array elements. For example, the achievable edge of coverage (EOC) secondary pattern directivity for the shaped beam directly tracks the radiating element's peak directivity. A 0.1 dB decrease in primary pattern peak directivity may result in a 0.1 dB decrease in secondary pattern EOC directivity.

Other important performance metrics for the feed array elements include polarization purity (or, equivalently, suppression of cross polarization) and radiation efficiency, i.e., the fraction of available power that is actually radiated by the element. Radiation efficiency incorporates the effects of impedance mismatch (return loss) and dissipation loss.

For closely spaced arrays, mutual coupling between neighboring elements can perturb and degrade the radiating elements' performance as reflected in one or more of the above mentioned metrics.

Performance degradation due to mutual coupling must be accommodated in communication system link budgets or suppressed. Known suppression techniques entail the use of additional components arranged between the radiating elements. For example, U.S. Pat. No. 2,987,747 to Atchison discloses that adjacent radiating elements may be shorted together at a distance of one quarter wavelength from a common aperture plane, generating an RF choke that inhibits mutual coupling. U.S. Pat. No. 4,115,782 to Han discloses metal tabs or clips inserted near the apertures of radiating elements to reduce mutual coupling effects. U.S. Pat. No. 4,219,820 to Crail discloses a planar metallic shape etched on a dielectric substrate that is inserted into the aperture of circular horn elements to provide coupling compensation between circularly polarized horn antennas to reduce degradation of polarization purity. Techniques disclosed in the above mentioned references rely, undesirably, on additional components, the installation, calibration and test of which add appreciably to the cost of the array, and which represent additional failure mechanisms that detract from the array's reliability.

Thus, improved techniques for reducing mutual coupling between radiating elements are desirable.

SUMMARY OF INVENTION

The present inventors have appreciated that reduced mutual coupling between array elements may be achieved, while avoiding the use of additional components. More particularly, the presently disclosed techniques reduce mutual coupling between radiating elements, particularly horns that would otherwise arise from fields radiated from each horn's aperture and from currents that flow along the horn's exterior surfaces and between horns arranged in an array.

The array of antenna feed elements includes a plurality of horns, each horn having an aperture and configured for transmission of electromagnetic energy therethrough. At least a first horn is configured with an electrically conductive external surface proximate to the aperture, the external surface contoured so as to reduce mutual coupling between the first horn and an adjacent horn. Where the electromagnetic energy is within a radio frequency (RF) band, the external surface is contoured so as to provide an abrupt change in a gap dimension between the first horn and an adjacent horn, the change occurring at a distance behind the aperture approximately equal to an integer multiple of one half the characteristic wavelength of the RF band.

In an implementation, an array of antenna feed elements includes a plurality of horns. Each horn includes an aperture at a distal end of the horn, configured for transmission of electromagnetic energy therethrough. At least a first horn is configured with an electrically conductive external surface proximate to the aperture, the external surface being contoured so as to reduce mutual coupling between the first horn and an adjacent horn.

In another implementation, the energy is within a radio frequency (RF) band, the first horn has an aperture external diameter $d_a$, and the first horn is separated from the adjacent horn by a center to center distance $d_{c\text{-}c}$. The external surface may be contoured so as to include at least a first portion and a second portion. The first portion may have a length l that extends from a longitudinal position proximate to the aperture toward a proximal end of the horn. The first portion may be contoured so as to provide, proximate to each adjacent horn, a first lateral gap between the first portion and an external surface of the adjacent horn. The first lateral gap may be approximately constant, throughout length l, length l being approximately $n\times\lambda/2$, where λ is a characteristic wavelength of the RF band and n is a positive integer. The second portion of the external surface may extend from the first portion toward an axial position proximate to the distal end, and provide, proximate to the adjacent horn, a second lateral gap significantly larger than the first lateral gap.

In a further implementation the first lateral gap may be approximately equal to the difference between $d_{c\text{-}c}$ and $d_a$.

In another implementation, n may equal one.

In a yet further implementation, the first lateral gap may be no greater than $d_a/10$.

In another implementation, each horn may include an electrically conductive interior surface. The interior surface may be shaped as a truncated cone. The interior surface may include one or more of a step, a taper, corrugations, and/or ridges.

In a further implementation, a cross section of the first horn, parallel to the aperture, may be circular, square, rectangular or hexagonal.

In a yet further implementation, the horns may be disposed in an array that conforms to a geometric plane, plane, or to a surface of revolution having a minimum radius of curvature that is significantly larger than the horn separation $d_{c\text{-}c}$, or to any other gently curved geometric shape.

In an implementation, an antenna feed element is configured as a horn, the horn comprising an aperture at a distal end of the horn, and configured for transmission of electromagnetic energy therethrough, the energy being within a radio frequency (RF) band, the horn being configured with an electrically conductive external surface proximate to the aperture, the external surface being contoured so as to reduce mutual coupling between the horn and an adjacent horn.

In an implementation, an antenna system includes an array of antenna feed elements illuminating a reflector, the array including a plurality of horns, each horn comprising an aperture at a distal end of the horn, and configured for transmission of electromagnetic energy therethrough, the energy being within a radio frequency (RF) band, at least a first horn being configured with an electrically conductive external surface proximate to the aperture, the external surface being contoured so as to reduce mutual coupling between the first horn and an adjacent horn.

BRIEF DESCRIPTION OF THE DRAWINGS

The included drawings are for illustrative purposes and serve only to provide examples of possible implementations of the disclosed inventive techniques. These drawings in no way limit any changes in form and detail that may be made by one skilled in the art without departing from the spirit and scope of the disclosed implementations.

Figure 1:
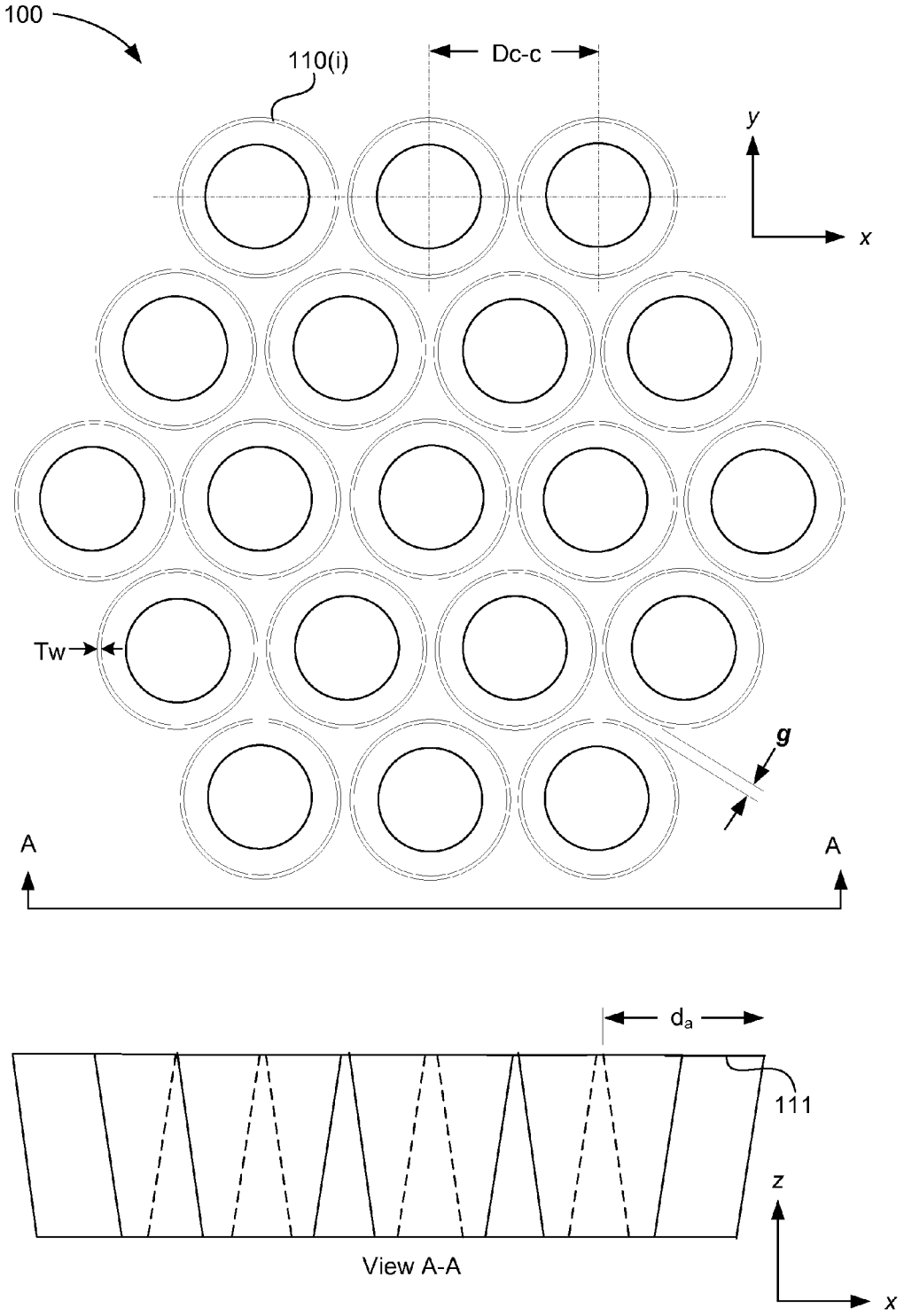
FIG. 1 illustrates array of feed elements each feed element configured as a circular horn antenna

Throughout the drawings, the same reference numerals and characters, unless otherwise stated, are used to denote like features, elements, components, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the disclosed subject matter, as defined by the appended claims.

DETAILED DESCRIPTION

Specific exemplary embodiments of the invention will now be described with reference to the accompanying drawings. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

It will be understood that when an element is referred to as being "connected" or "coupled" to another element, it can be directly connected or coupled to the other element, or intervening elements may be present. Furthermore, "connected" or "coupled" as used herein may include wirelessly connected or coupled. It will be understood that although the terms "first" and "second" are used herein to describe various elements, these elements should not be limited by these terms. These terms are used only to distinguish one element from another element. Thus, for example, a first user terminal could be termed a second user terminal, and similarly, a second user terminal may be termed a first user terminal without departing from the teachings of the present invention. As used herein, the term "and/or" includes any and all combinations of one or more of the associated listed items. The symbol "/" is also used as a shorthand notation for "and/or".

The terms "spacecraft", "satellite" and "vehicle" may be used interchangeably herein, and generally refer to any orbiting satellite or spacecraft system.

As use herein and in the claims, the term "transmission" relates to RF band electromagnetic energy coupled across an aperture of a horn antenna, and encompasses either or both of energy that is emitted by the horn antenna and energy that is received by the horn antenna.

The present inventor has appreciated that mutual coupling between a first horn and an adjacent horn of an array of antenna feed horns may be reduced by providing the first horn with an electrically conductive external surface having a contoured shape as described hereinbelow.

The presently disclosed techniques, and the meaning of certain terms used herein, and in the claims, may be better understood by referring first to FIG. 1, which illustrates an array 100 of feed elements 110(*i*). In the illustrated example, array 100 includes 19 feed elements, each configured as a circular horn antenna, arranged in a triangular lattice. A greater or smaller number of horns may be contemplated, and the array may include horns arranged in other regular or irregular lattice-like arrangements. For example, the array may be configured as a square lattice. Each horn 110(*i*) may have an aperture 111 of diameter $d_a$. Aperture 111 of each horn may be substantially coplanar with apertures of other horns in the array. For convenience of description, an x-y plane, parallel to the aperture plane is defined. A distance in the x-y plane may be referred to as a lateral distance, whereas a distance in a z-direction orthogonal to the x-y plane may be referred to as a longitudinal or axial distance.

For convenience of description, aperture 111 may be referred to as being disposed at a distal end of the horn, an end opposite to which may be referred to as a proximal end. Similarly, a position between the distal end of the horn and the proximal end of the horn may be referred to as being "behind" the aperture.

It will be noted that each horn is separated from an adjacent horn by a center-to-center distance $d_{c-c}$ which is at least slightly larger than $d_a$, so as to assure a positive gap distance g between two adjacent horns at the point of closest approach between the horns. It is desirable that gap g be small relative to $d_a$. For example, g may be about $1/20^{th}$ of $d_a$.

Each horn may be formed of a conductive material configured in a generally conical shape, having a wall thickness $T_w$. Commonly, $T_w$ will be fairly uniform along the longitudinal direction, and small relative to $d_a$. In the absence of the present teachings, $T_w$ may be no thicker than determined to be necessary to provide a desired structural rigidity, for example.

Figure 2:
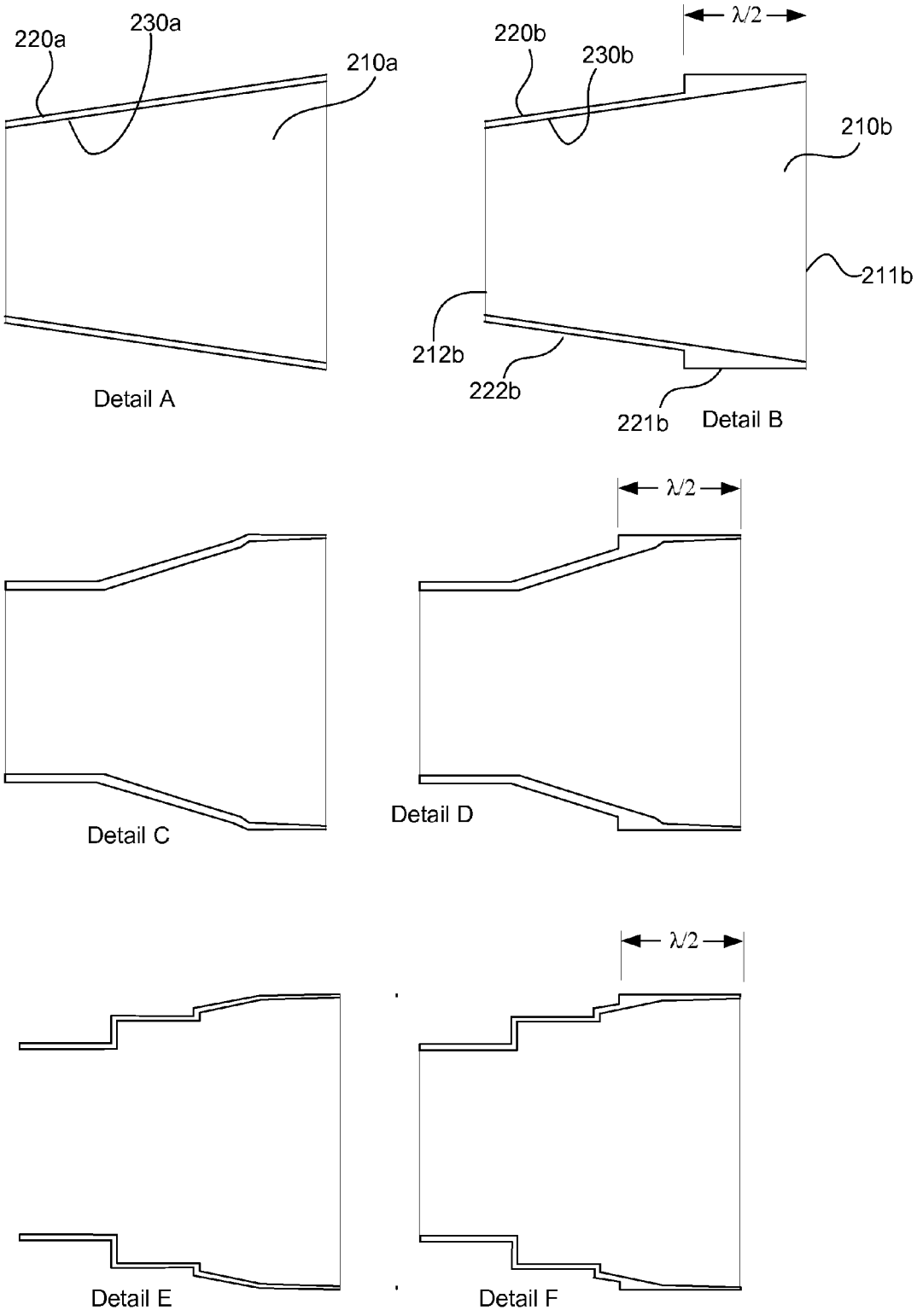
FIG. 2 illustrates a comparison between conventional horn antennas and horn antennas configured in accordance with the present teachings.

Referring now to FIG. 2, a comparison between conventional horn antennas and horn antennas configured in accordance with the present teachings is illustrated. In Detail A for example, a cross section of a simple conical horn antenna 210*a* of the prior art is illustrated. In Detail B, a horn antenna 210*b*, configured in accordance with the present teachings is illustrated. Horn antenna 210*b* may include electrically conductive interior surface 230*b* and electrically conductive exterior surface 220*b*. It will be appreciated that electrically conductive interior surface 230*b* and electrically conductive exterior surface 220*b* may be respective surfaces of an integral electrically conductive wall. Interior surface 230*b* of horn antenna 210*b* may be arranged in substantially the same shape as interior surface 230*a* of horn antenna 210*a*. Exterior surface 220*b*, however, is, advantageously, contoured to so as to reduce mutual coupling between horn 210*b* and an adjacent horn (not illustrated).

More particularly, external surface 220*b* may be contoured so as to include a first portion 221*b* and a second portion 222*b*. First portion 221*b* extends a length λ/2 in the longitudinal direction from the plane of aperture 211*b* of horn 210*b* toward proximal end 212*b*. It will be appreciated that λ/2 represents a distance that is one half the characteristic wavelength of electromagnetic energy desired to be transmitted through horn 210*b*. Along length λ/2, a first lateral gap between first portion 221*b* and an external surface of the adjacent horn (not illustrated) may be approximately constant as a function of longitudinal position.

Second portion 222*b* of external surface 220*b* extends from first portion 221*b* toward an axial position proximate to proximal end 212*b* of horn 210*b*. Advantageously, second portion 222*b* provides, proximate to the adjacent horn (not illustrated), a second lateral gap that is substantially larger than the first lateral gap.

As a result, a gap between adjacent horns is relatively narrow and constant for a longitudinal distance ("gap length") of λ/2. It will be appreciated that this gap may behave, effectively, as a waveguide transmission line for electromagnetic energy associated with RF signals being transmitted through horn 210*b*. For the length of portion 221*b*, that is, for a gap length of λ/2, the gap is relatively constant and narrow and will therefore have a relatively low characteristic impedance. Starting at a distance of approximately λ/2 from the aperture, the gap becomes significantly wider. For example, the gap width may increase in size by a factor of about two or more. In an implementation, the transition in gap width occurs abruptly and the characteristic impedance of the effective waveguide transmission line becomes abruptly much larger at the point of transition. The abrupt change in gap width may occur as a result in a step change in external diameter, as illustrated, or by use of a steep taper, for example. As a result, an open circuit termination of the transmission line is effectively created, the transmission line therefore being approximately one half wavelength in length. It will be appreciated that the approximately half wavelength transmission line may reflect this high impedance termination to the aperture plane. Put simply, contouring the horn external surface so as to provide an abrupt change in gap dimension as described above may produce an RF choke that substantially decreases mutual couplings between the horns enhances the radiation properties of each horn.

Although Detail A and Detail B illustrate an interior surface arranged in the shape of a simple truncated cone, it will be appreciated that the principles of the presently disclosed techniques may be applied to horns of any interior configuration. Known horn antennas, for example, may have various steps, tapers, corrugations, and/or ridges to achieve various performance objectives. In the absence of the present teachings, an exterior wall may approximately follow those variations in contour, as illustrated in Detail C and Detail E so as to minimize mass.

By comparing Detail C and Detail E with, respectively, Detail D and Detail F, it will be better appreciated how the presently disclosed techniques provide for an abrupt change in gap dimension at a longitudinal position λ/2 behind the aperture plane, irrespective of the configuration of the interior surface configuration of the horn.

Although the illustrated examples provide for a gap length of λ/2, it will be appreciated that the principles of the presently disclosed techniques are applicable to gap lengths of n×λ/2where n may be any positive integer.

Figure 3:
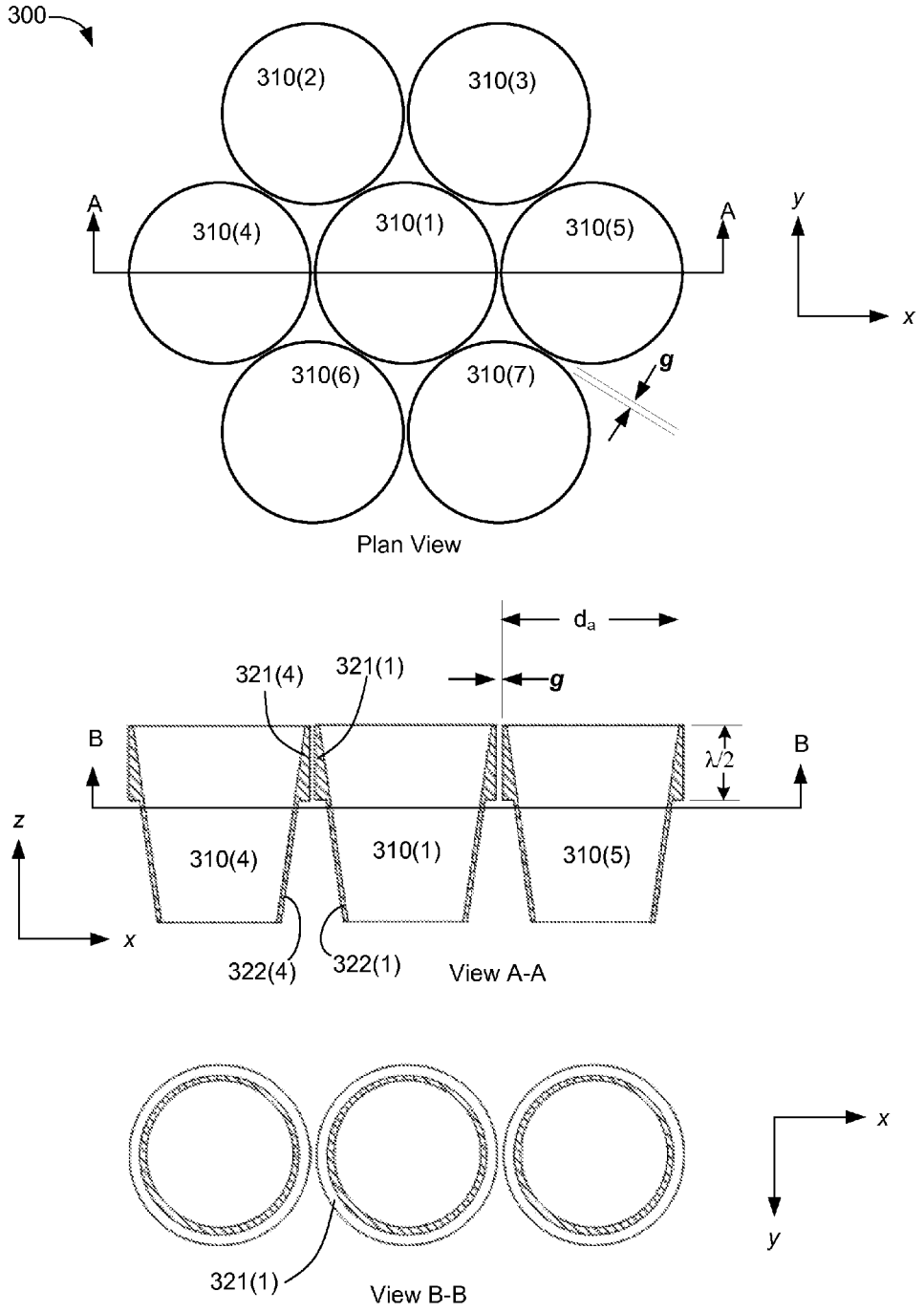
FIG. 3 illustrates an array of antenna feed elements, according to an implementation.

Referring now to FIG. 3, an array 300 of antenna feed elements, including seven horns arranged in a triangular lattice is illustrated. The "Plan View" illustrates a view of the aperture plane taken along the z-axis. It will be noted that, for such a triangular lattice, an individual horn 310(*i*) may be proximate to up to six "adjacent" horns. For example, horn 310(1) is illustrated as being adjacent to each of horn 310(2), horn 310(3), horn 310(4), horn 310(5), horn 310(6), and horn 310(7). In an implementation, the horns may be arranged such that an approximately identical gap g is provided between each pair of adjacent horns.

Referring now to View A-A of FIG. 3, it may be observed that adjacent horns may be configured and arranged such that gap g is approximately constant along a longitudinal gap length distance λ/2 that extends from the aperture plane toward the distal end. As indicated above, λ may be a characteristic wavelength of the RF band desired to be transmitted through the horn. More particularly, referring now to adjacent horns 310(1) and 310(4), it is illustrated how first portion 321(1) of horn 310(1) and first portion 321(4) of horn 310(4) are configured so as to provide a constant gap g. Starting at a point λ/2 behind the aperture plane, second portion 322(1) of horn 310(1) and second portion 322(4) of horn 310(4) are configured so as to provide a lateral separation substantially larger than gap g.

In the illustrated implementation, as may be observed in View B-B, first portion 321(1) may have a circular cross section. In such implementations, the circular cross section may be approximately equal to aperture diameter $d_a$.

Figure 4:
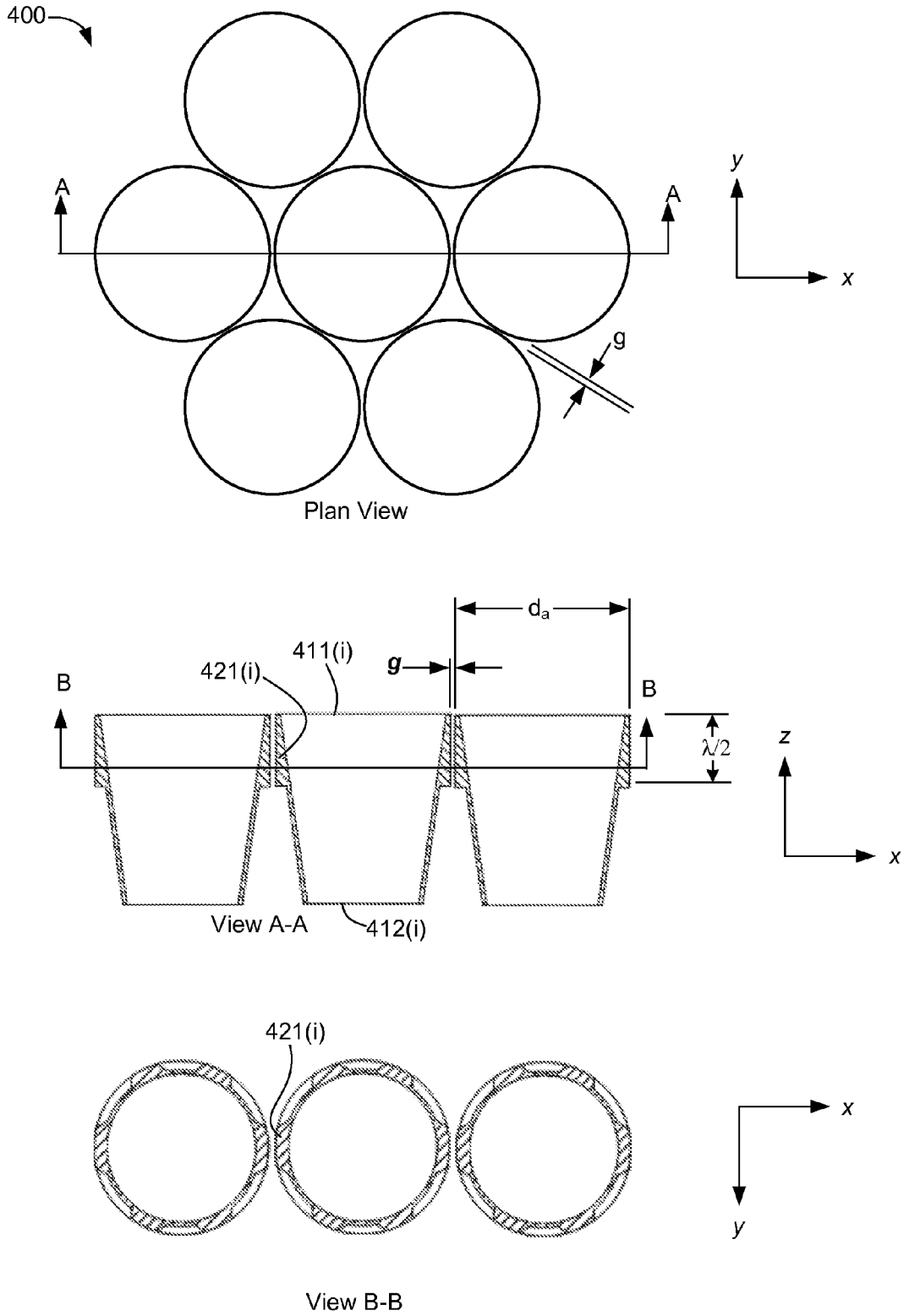
FIG. 4 illustrates an array of antenna feed elements, according to another implementation.

Referring now to FIG. 4, an array 400 of antenna feed elements, including seven horns arranged in a triangular lattice is illustrated. The "Plan view" illustrates a view of the aperture plane taken along the Z-axis. As illustrated, the horns may be arranged such that an approximately identical gap g is provided between each pair of adjacent horns.

Referring now to View A-A of FIG. 4, it may be observed that adjacent horns may be configured and arranged such that gap g is approximately constant along an axial distance λ/2 extending from aperture plane 411(*i*) toward proximal end 412(*i*). As indicated above, λ may be a characteristic wavelength of the RF band desired to be transmitted through the horn.

In the illustrated implementation, as may be observed in View B-B, first portion 421(*i*) may have a scalloped circumference, such that only regions of the circumference proximate to an adjacent horn have a radius approximately equal to one half aperture diameter $d_a$. Regions of the circumference not proximate to an adjacent horn may have a smaller radius, so as to minimize wall thickness, for example. Moreover, a profile of first portion 421(*i*) may be configured such a that the transmission line profile has a meander or wave-like deviation from a straight longitudinal direction in order to decrease a z-axis dimension of the transmission line.

Figure 5:
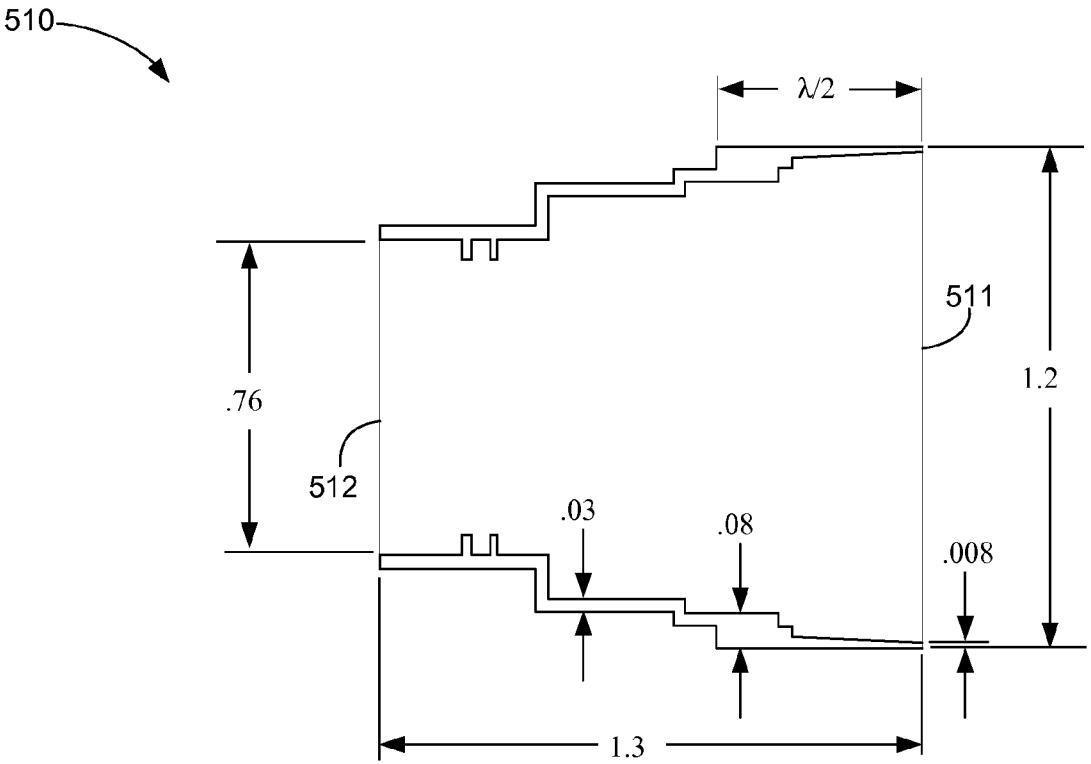
FIG. 5 illustrates a horn antenna, according to an implementation.

Referring now to FIG. 5, an example implementation of a horn antenna 510 having a circular cross section, configured in accordance with the presently disclosed techniques is illustrated. The illustrated implementation, with dimensions indicated in inches, may be suitable for operation with circularly polarized RF energy within a frequency range of 12.4-12.7 GHz. It will be observed that an outside diameter of horn antenna 510 is approximately constant for a distance λ/2 extending from aperture plane 511 toward proximal end 512. As indicated above, λ may be a characteristic wavelength of the RF band desired to be transmitted through the horn. In the illustrated implementation, λ may be the free space wavelength of electromagnetic radiation at a center frequency within the range 12.4-12.7 GHz, for example.

Figure 6:
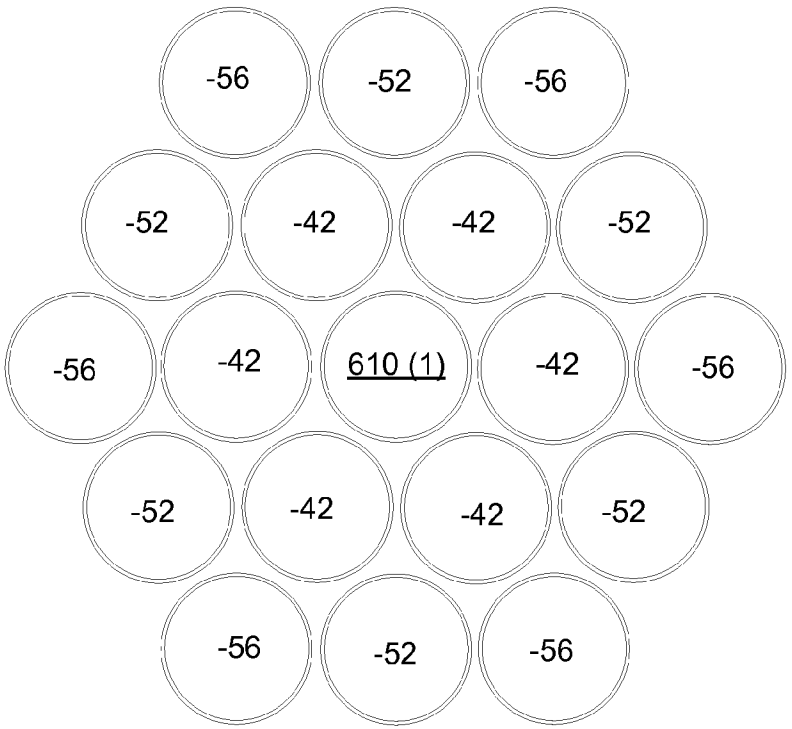
FIG. 6 illustrates a comparison of mutual coupling performance of arrays of antenna feed elements.
Figure 6:
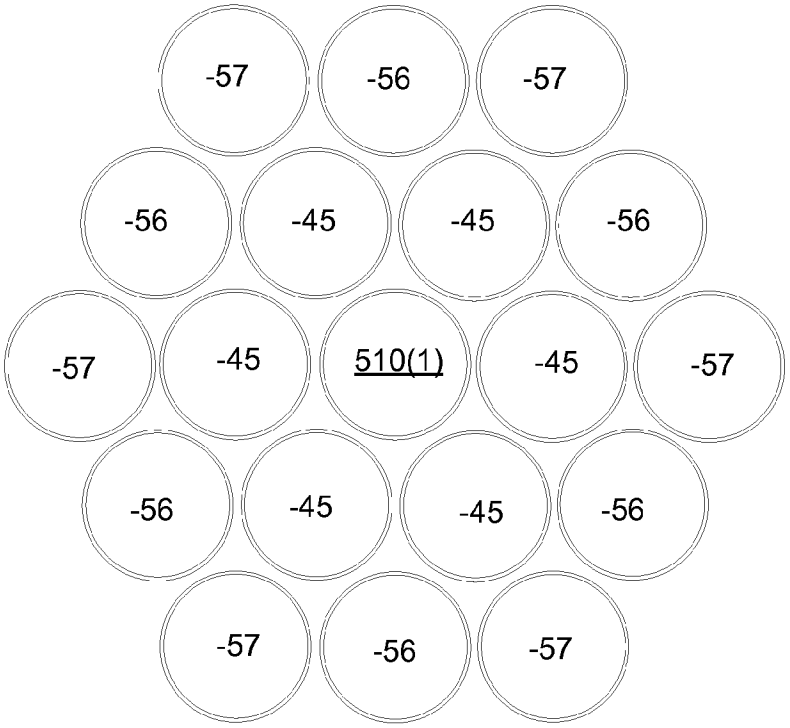

The effect of the presently disclosed techniques on mutual coupling performance of an array of horn antennas may be better appreciated by referring to FIG. 6. Plot A illustrates mutual coupling performance of an array horn antennas 510 operating at 12.6 GHz in a dual polarized mode. More particularly, for a unit amount of power input to horn antenna 510(1) at a first polarization (for example, left hand circular polarization (LCHP)) an amount of power coupled into neighboring elements at a second polarization (for example, right hand circular polarization) is indicated, expressed in dB. It will be observed that, for horns adjacent to 510(1) mutual coupling is limited to about −45 dB. Referring to Plot B, performance of a horn antenna array in the absence of the present invention is illustrated for comparison. Horn antenna 610(1) is an antenna of the prior art which, for purposes of this comparison, is assumed to have interior surfaces configured identically to horn antenna 510(1), and be operating at the same frequency and dual polarized mode. It will be observed that mutual coupling between horn antenna 610(1) and neighboring elements is about −42 dB, or about 3 dB worse than for horn antenna 510(1).

Figure 7:
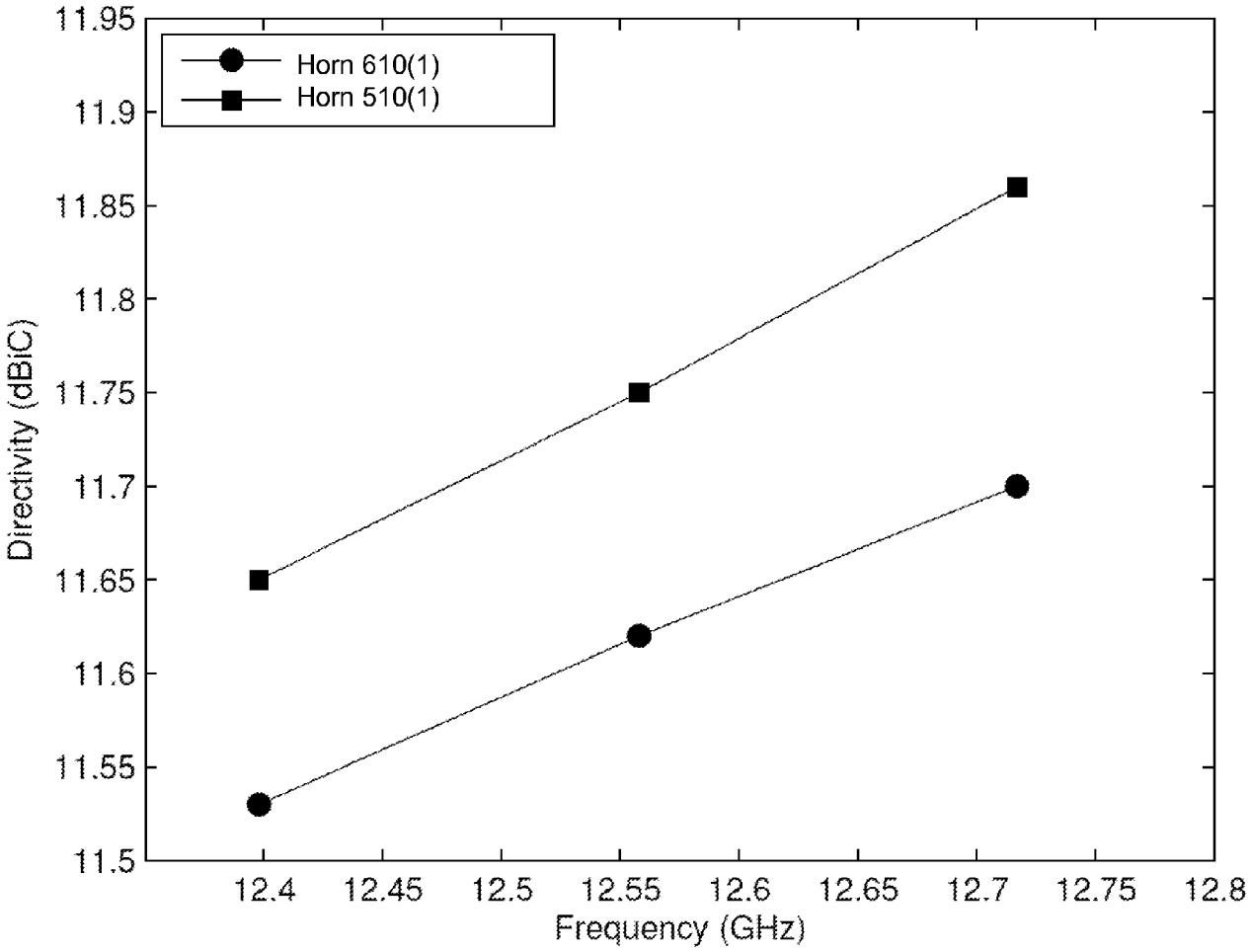
FIG. 7 illustrates a comparison of co-polarization directivity.

The effect of the presently disclosed techniques on radiating element directivity for an array of horn antennas may be better appreciated by referring to FIG. 7, which presents a plot of co-polarization ("copol") directivity for horn antenna 510(1), and 610(1), when operating in respective arrays as illustrated in FIG. 6. More particularly, the peak partial directivity to right-hand circular polarization (RHCP) of the center elements 510(1) and 610(1) of the arrays shown in FIG. 6 is plotted as a function of frequency when said center elements are excited for intended RHCP operation. It may be observed that horn antenna 510(1) exhibits an improvement in copol directivity of about 0.12 dB to 0.16 dB relative to performance of horn antenna 610(1) of the prior art.

Figure 8:
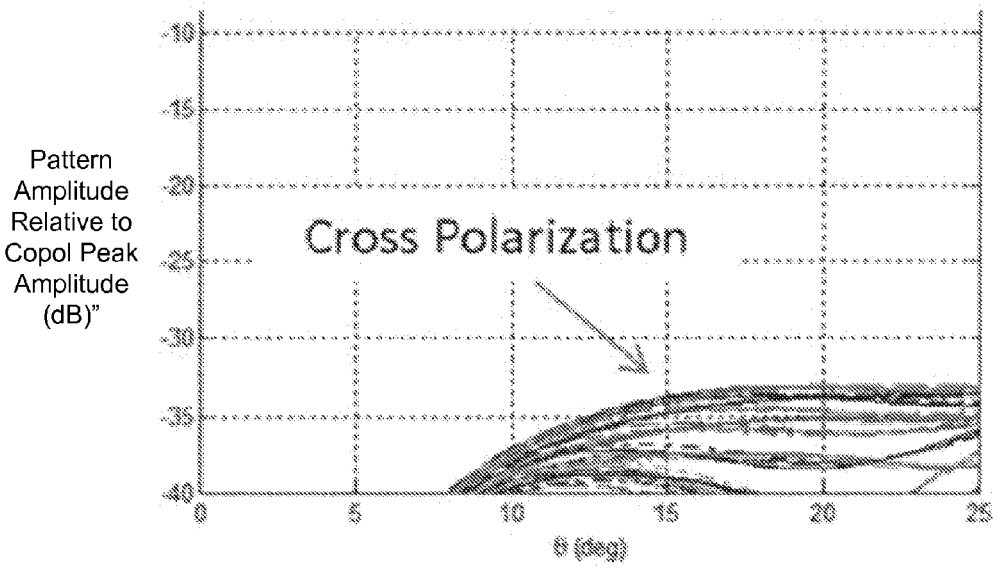
FIG. 8 illustrates a comparison of normalized cross polarization amplitude.
Figure 8:
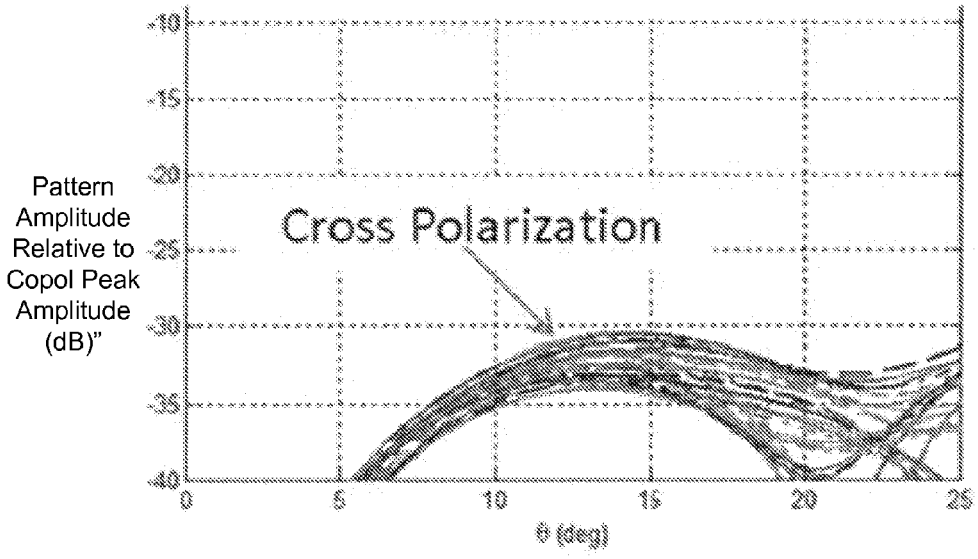

The effect of the presently disclosed techniques on cross polarization performance of an array of horn antennas may be better appreciated by referring to FIG. 8, which presents a plot of normalized cross polarization amplitude. More particularly, FIG. 8 illustrates normalized LCHP pattern amplitude of an array horn antenna 510 operating at 12.6 GHz when the horn is excited for intended RHCP operation. In the example plots C and D, normalized cross polarization pattern amplitude, expressed in dB relative to the copol peak amplitude, is plotted as a function of angle θ from boresight for a number of azimuthal planes. Cross-polarization is shown to be limited to no worse (i.e. no higher) than −33 dB with respect to peak copol directivity. Referring to Plot D, performance of a horn antenna array in the absence of the present invention is plotted in a similar manner for comparison. Here, cross polarization of nearly −30 dB with respect to peak copol directivity was found. It can be observed, therefore, that about 3 dB improvement in cross polarization may be obtained using the presently disclosed techniques.

Thus, techniques for reducing mutual coupling between array elements have been described. Advantageously, the disclosed techniques avoid reliance on adding components to or between the array elements. While various embodiments have been described herein, it should be understood that they have been presented by way of example only, and not limitation. It will thus be appreciated that those skilled in the art will be able to devise numerous systems and methods which, although not explicitly shown or described herein, embody said principles of the invention and are thus within the spirit and scope of the invention as defined by the following claims.

What is claimed is:

1. An array of antenna feed elements comprising a plurality of horns, each horn including an aperture at a distal end of the horn, and configured for transmission of electromagnetic energy therethrough, the energy being within a radio frequency (RF) band, at least a first horn being configured with an electrically conductive external surface proximate to the aperture, the external surface being contoured so as to reduce mutual coupling between the first horn and an adjacent horn, wherein:

the external surface is contoured so as to include at least a first portion and a second portion;

the first portion has a length l that extends from a longitudinal position proximate to the aperture toward a proximal end of the horn, the first portion being contoured so as to provide, proximate to each adjacent horn, a first lateral gap between the first portion and an external surface of the adjacent horn;

the second portion of the external surface extends from the first portion toward an axial position proximate to the proximal end, and provides, proximate to the adjacent horn, a second lateral gap significantly larger than the first lateral gap;

the first horn has an aperture external diameter $d_a$, and is separated from the adjacent horn by a center to center distance $d_{c\text{-}c}$; and the first lateral gap is approximately constant, throughout length l, length l being approximately n×λ/2, where λ is a characteristic wavelength of the RF band and n is a positive integer.

2. The array of claim 1, wherein:

the first lateral gap is approximately equal to the difference between $d_{c\text{-}c}$ and $d_a$.

3. The array of claim 1, wherein n equals one.

4. The array of claim 1, wherein the first lateral gap is no greater than $d_a/10$.

5. The array of claim 1, wherein each horn comprises an electrically conductive interior surface.

6. The array of claim 5, wherein the interior surface is shaped as a truncated cone.

7. The array of claim 5, wherein the interior surface includes one or more of a step, a taper, corrugations, and/or ridges.

8. The array of claim 1, wherein a cross section of the first horn, parallel to the aperture, is circular.

9. The array of claim 1, wherein a cross section of the first portion, parallel to the aperture, is a circular annulus.

10. The array of claim 1, wherein a cross section of the first portion, parallel to the aperture, has a circular inner circumference and a scalloped outer circumference.

11. The array of claim 1, wherein a cross section of the first horn, parallel to the aperture, is square, rectangular or hexagonal.

12. The array of claim 1, wherein the horns are disposed in an array that conforms to a geometric plane, or to a surface of revolution having a minimum radius of curvature that is significantly larger than the horn separation $d_{c-c}$, or to any other gently curved geometric shape.

13. An antenna feed element configured as a horn, the horn comprising an aperture at a distal end of the horn, and configured for transmission of electromagnetic energy therethrough, the energy being within a radio frequency (RF) band, the horn being configured with an electrically conductive external surface proximate to the aperture, the external surface being contoured so as to reduce mutual coupling between the horn and an adjacent horn, wherein:

the external surface is contoured so as to include at least a first portion and a second portion;

the first portion has a length l that extends from a longitudinal position proximate to the aperture toward a proximal end of the horn, the first portion being contoured so as to provide, proximate to the adjacent horn, a first lateral gap between the first portion and an external surface of the adjacent horn; and the second portion of the external surface extends from the first portion toward an axial position proximate to the distal end, and provides, proximate to the adjacent horn, a second lateral gap significantly larger than the first lateral gap; and the first lateral gap is approximately constant, throughout length l, length l being approximately $n \times \lambda/2$, where $\lambda$ is a characteristic wavelength of the RF band and n is a positive integer.

14. The array of claim 13, wherein n equals one.

15. The antenna feed element of claim 13, wherein the horn comprises an electrically conductive interior surface shaped as a truncated cone.

16. The antenna feed element of claim 15, wherein the interior surface includes one or more of a step, a taper, corrugations, and/or ridges.

17. The antenna feed element of claim 13, wherein a cross section of the horn, parallel to the aperture, is circular, square, rectangular or hexagonal.

18. An antenna system comprising an array of antenna feed elements illuminating a reflector, the array including a plurality of horns, each horn comprising an aperture at a distal end of the horn, and configured for transmission of electromagnetic energy therethrough, the energy being within a radio frequency (RF) band, at least a first horn being configured with an electrically conductive external surface proximate to the aperture, the external surface being contoured so as to reduce mutual coupling between the first horn and an adjacent horn, wherein:

the first horn has an aperture external diameter $d_a$, and is separated from the adjacent horn by a center to center distance $d_{c-c}$;

the external surface is contoured so as to include at least a first portion and a second portion;

the first portion has a length l that extends from a longitudinal position proximate to the aperture toward a proximal end of the horn, the first portion being contoured so as to provide, proximate to each adjacent horn, a first lateral gap between the first portion and an external surface of the adjacent horn, the first lateral gap being approximately constant, throughout length l, length l being approximately $n \times \lambda/2$, where $\lambda$ is a characteristic wavelength of the RF band and n is a positive integer; and the second portion of the external surface extends from the first portion toward an axial position proximate to the distal end, and provides, proximate to the adjacent horn, a second lateral gap significantly larger than the first lateral gap.

* * * * *